US006446632B1

(12) United States Patent
Focke

(10) Patent No.: US 6,446,632 B1
(45) Date of Patent: Sep. 10, 2002

(54) PROCESS AND APPARATUS FOR DETECTING AND ELIMINATING DEFECTIVE AND/OR INCORRECTLY POSITIONED CIGARETTES

(75) Inventor: Heinz Focke, Verden (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/496,219

(22) Filed: Feb. 1, 2000

(30) Foreign Application Priority Data

Feb. 1, 1999 (DE) ..... 199 03 777

(51) Int. Cl.[7] ..... A24C 1/14

(52) U.S. Cl. ..... 131/282; 131/280; 131/906; 131/910; 209/535; 209/536; 206/236; 206/248; 356/394

(58) Field of Search ..... 131/282, 280, 131/906, 910; 209/535, 536; 206/236, 248; 356/394

(56) References Cited

U.S. PATENT DOCUMENTS 4,174,780 A 11/1979 Farrar et al.
4,363,332 A 12/1982 Preston et al.
4,976,544 A * 12/1990 Neri ..... 356/394

FOREIGN PATENT DOCUMENTS

| | | |
|---|---|---|
| DE | 2 320 396 | 10/1974 |
| DE | 36 13 090 | 10/1987 |
| DE | 39 20 888 | 1/1990 |
| DE | 44 24 045 | 1/1996 |

* cited by examiner

*Primary Examiner*—Christopher A. Fiorilla
*Assistant Examiner*—Mark Halpern
(74) *Attorney, Agent, or Firm*—Sughrue Mion, PLLC

(57) ABSTRACT

A process and an apparatus for detecting and eliminating, defective and/or incorrectly positioned, in particular transversely located, cigarettes in the cigarette magazine of a cigarette-production and/or a cigarette-packaging machine. Thus, the avoidance of disruptions in the cigarette magazine is improved. For detection using an optical checking element, an image of the cigarettes located in the cigarette magazine is scanned, the image is evaluated by an image-processing device and, if, during the evaluation, the scanned image is established as deviating from a reference image and/or reference value, an error signal is produced. For eliminating defective cigarettes, an ejecting unit arranged in the region of the magazine is actuated in order to eject a plurality of cigarettes.

6 Claims, 4 Drawing Sheets

PROCESS AND APPARATUS FOR DETECTING AND ELIMINATING DEFECTIVE AND/OR INCORRECTLY POSITIONED CIGARETTES

BACKGROUND OF THE INVENTION

The invention relates to a process and an apparatus for detecting, and to a process and an apparatus for eliminating, defective and/or incorrectly positioned, in particular transversely located, cigarettes in the cigarette magazine of a cigarette-production and/or cigarette-packaging machine.

Cigarette production and/or cigarette packaging machines usually have a cigarette store in which cigarettes, as they move downwards, end up being located transversely to the rest of the cigarettes and can block individual shafts or shaft groups located beneath the storage part. The following cigarettes can then no longer pass into the respective shafts or shaft groups. This results in the respective shafts or shaft groups being put out of action. The task of eliminating such disruptions is laborious and costly since it is usually necessary to switch off the machine.

In order to avoid costly steps involved in eliminating disruptions to a blocked shaft or shaft group, an operator usually watches the cigarette magazine and removes any transversely positioned cigarette with long pincers. Here there is a risk of human error since, on account of the monotony of the task, the operator's attention decreases over time. Furthermore, disruptions which remain undetected may take place when the operator is absent.

The problem on which the invention is based is thus to improve the avoidance of disruptions in the cigarette magazine.

SUMMARY OF THE INVENTION

In order to solve this problem, a detection process according to the invention is characterized in that, using at least one optical checking element, at least one image of a plurality of cigarettes located in the cigarette magazine is detected, the image is evaluated by an image-processing device and—if, during the evaluation, the scanned image is established as deviating from a reference image and/or from at least one reference value—an error signal is produced.

A detection apparatus according to the invention is characterized by an optical checking element, in particular a camera, which is arranged in the region of the cigarette magazine and is intended for scanning at least one image of a plurality of cigarettes located in the cigarette magazine, by an image-processing device for evaluating the image and by means by which an error signal can be produced if the scanned image is established as deviating from a reference image and/or from at least one reference value.

The advantage of this process and of this apparatus is the monitoring of a relatively large area of cigarettes rather than merely individual cigarette ends, since this provides an overview of the orientation of the cigarettes. Provision is thus made for detecting an image of a relatively large area of the cigarette magazine, namely a plurality of cigarettes, and for subjecting this to image processing. Finally, using image-processing methods, deviations from reference images and/or reference values can be established and, if necessary, a corresponding error signal can be produced. This makes it possible to detect transversely located cigarettes.

Furthermore, this process and this apparatus may also be used to register defective cigarettes in addition to incorrectly positioned cigarettes. For example, in the case where images of filter cigarettes are stored, a missing filter can be diagnosed by image processing. However, it is also possible to register bent or broken cigarettes, since these too constitute a deviation from a reference image.

A disruption detected in this way can be eliminated automatically or manually. With a manual elimination of disruption, the error signal is preferably emitted acoustically or optically, e.g. by a siren or horn or by a warning light. Such a signal then tells the operator to intervene. However, errors may also be eliminated automatically.

In order to solve the problem further, an elimination process according to the invention is characterized in that a defective and/or incorrectly positioned cigarette is detected, in particular in accordance with one of the processes described above, and, in reaction to such detection, an ejecting unit arranged in the region of the magazine is actuated in order to eject a plurality of cigarettes located in an ejecting zone assigned to the ejecting unit.

An elimination apparatus according to the invention is characterized by at least one, or in particular a plurality of, adjacent ejecting unit which are arranged in the region of the magazine and are intended for ejecting a plurality of cigarettes located in an ejecting zone assigned to an ejecting unit. The number of cigarettes ejected in this case is large enough for a transversely located cigarette to be ejected in full.

A plurality of adjacent ejecting zones with a corresponding number of ejecting units are preferably provided. This has the advantage that it is not necessary to eject the cigarettes over the entire width of the cigarette magazine. It may thus be the case that a transversely located cigarette extends over two ejecting zones. In this case, preferably two adjacent ejecting units are actuated and a correspondingly larger number of cigarettes is ejected.

BRIEF DESCRIPTION OF THE DRAWING

The front and rear walls of the ejecting unit are preferably of different sizes and contours such that the contour of the rear wall is greater than the contour of the front wall by at least the width of one cigarette. This avoids jamming of cigarettes only partially gripped by the front wall.

Further details of the invention can be gathered from the subclaims and with reference to an exemplary embodiment illustrated in the drawing, in which:

DETAILED DESCRIPTION OF THE INVENTION

Figure 1:
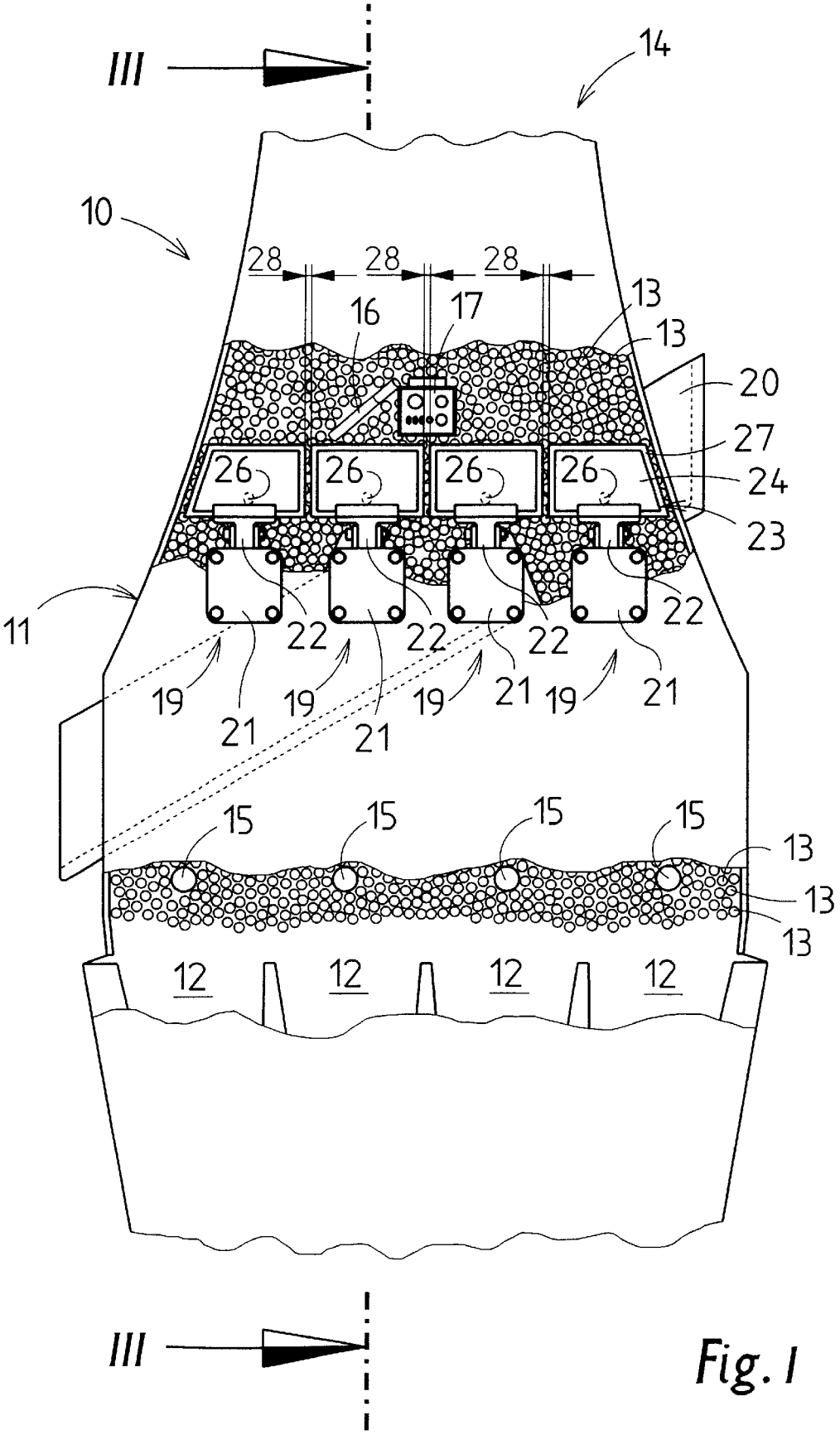
FIG. 1 shows a front view of a cigarette magazine with a camera and four ejecting units arranged in the storage part of the cigarette magazine.

FIG. 1 shows a cigarette magazine 10 which has a storage part and four shaft groups 12 arranged therebeneath. Each of these shaft groups has seven shafts of essentially the width of one cigarette.

The cigarette magazine 10 contains a plurality of cigarettes 13, illustrated by circles. With the correct positioning of these cigarettes 13, it is only the filter-side or opposite end of the cigarette 13 which can be seen in the front view illustrated in FIG. 1. In other words, the plurality of cigarettes are located parallel to one another and are aligned horizontally, the ends of all the cigarettes 13 ideally being located essentially in a vertical plane. The depth of the cigarette magazine 10, in particular the depth of the space of the cigarette magazine 10 which receives the cigarettes 13, corresponds essentially to the length of one cigarette or is slightly larger than the length of one cigarette.

The cigarettes 13 pass through a top opening 14 into the cigarette magazine 10. On account of the force of gravity, the cigarettes 13 move downwards into the. cigarette magazine 10, where they pass to the shaft groups 12. At the outlet of the shaft groups 12, the cigarettes 13 are grouped in accordance with the formation which is to be received by a pack. Furthermore, the cigarette magazine 10 has four oscillating rods 15 which ensure that the cigarettes 13 are moved downwards uniformly into the shaft groups 12.

It is occasionally possible for a cigarette 13 within the cigarette magazine 10 to end up being located in a position which differs from the ideal alignment. For example, a cigarette 13 can skew. A cigarette positioned incorrectly in this way is illustrated as a transversely located cigarette 16. If a transversely located cigarette 16 moves downwards over time in the direction of the shaft groups 12, a blockage of such shaft groups 12 may occur. This usually results in the initially mentioned disruption to the production sequence. In particular the elimination of such disruption involves high outlay. The cigarette magazine 10 is thus provided with an optical checking element, namely a camera 17. The camera 17 monitors the cigarette ends through a window or a transparent wall of the cigarette magazine 10. In particular, the camera 17 scans an image of the cigarette magazine 10 over essentially the entire width of the cigarette magazine 10.

An image-processing device 18 evaluates the scanned image. In this case, the scanned image is compared with a reference image, for example. Alternatively, the scanned image is subjected to preprocessing, in which case characteristic values of the image are produced and/or calculated. By virtue of a comparison of these values with reference values, and/or of the scanned image with the reference image, errors can be detected, for example if there is a deviation or if a deviation exceeds a certain threshold value. Finally, a detected error results in the generation of an error signal, which results in at least one of four ejecting units 19 being actuated. This actuation causes the cigarettes 13 located in the region of the ejecting unit 19 to be pushed out to the rear side of the cigarette magazine 10 and thus ejected. The ejected cigarettes 13 drop into an inclined chute 20 along which the cigarettes 13 slide down and are finally fed to a tobacco-recycling circuit.

The tobacco recycling takes place by the cigarette being divide up into tobacco, cigarette paper and filter. The recovered tobacco is finally reused in cigarette production. This means that the tobacco waste which is produced when, as a transversely located cigarette is ejected, a plurality of other non-defective or correctly positioned cigarettes are likewise ejected can be kept low.

Each ejecting unit 19 has a housing 21 which is fixed relative to the cigarette magazine 10 or is connected thereto. The housing 21 has a linear cylinder which serves for guiding a linearly displaceable carriage 22. Said carriage 22, in turn, is connected to the actual ejector 23 of the ejecting unit 19. The ejector 23 has a front wall 24 and a rear wall 25 (illustrated in FIG. 3). The front wall 24 and rear wall 25 are connected to one another by a connecting element, namely a connecting rod 26.

If the ejecting unit 19 is located in a position referred to as a "through position", the front wall 24 of the ejector 23 terminates essentially flush with the front inner side of the cigarette magazine 10 and the rear wall 25 of the ejector 23 terminates essentially flush with the rear inner side of the cigarette magazine 10. In this through position, the cigarettes 13 can pass the storage part 11 of the cigarette magazine 10 in the region of the ejecting unit 19 without obstruction. It is only the connecting rod 26, which is of thin configuration, which results in a slight narrowing of the width of the cigarette magazine 10 in this region, which, however, is of no importance for the downward movement of the cigarettes 13 and thus for the cigarette transportation through the cigarette magazine 10.

If, however, the ejecting unit 19 is actuated, both the front wall 24 and rear wall 25 of the ejector 23 are displaced in the direction of the rear wall 25 of the ejector 23 and/or in the direction of the chute 20. The front wall 24 of the ejector 23 is connected to a housing-like device 27, of which the cross section corresponds to the contour of the front wall 24 of the ejector 23. This housing-like device prevents cigarettes 13 from dropping into the region of the ejector 23 when the ejector 23 is located in the ejecting position. This makes it possible to avoid the situation where, when the ejector 23 is drawn back into its through position, cigarettes 13 which have dropped into this region block the ejector.

Furthermore, the four front walls 24 and/or housing-like devices 27 of the four ejectors 23 are spaced apart from one another. The distance 28 between the front walls 24 corresponds approximately to double the width of one cigarette, but it may also be selected to be larger.

Figure 2:
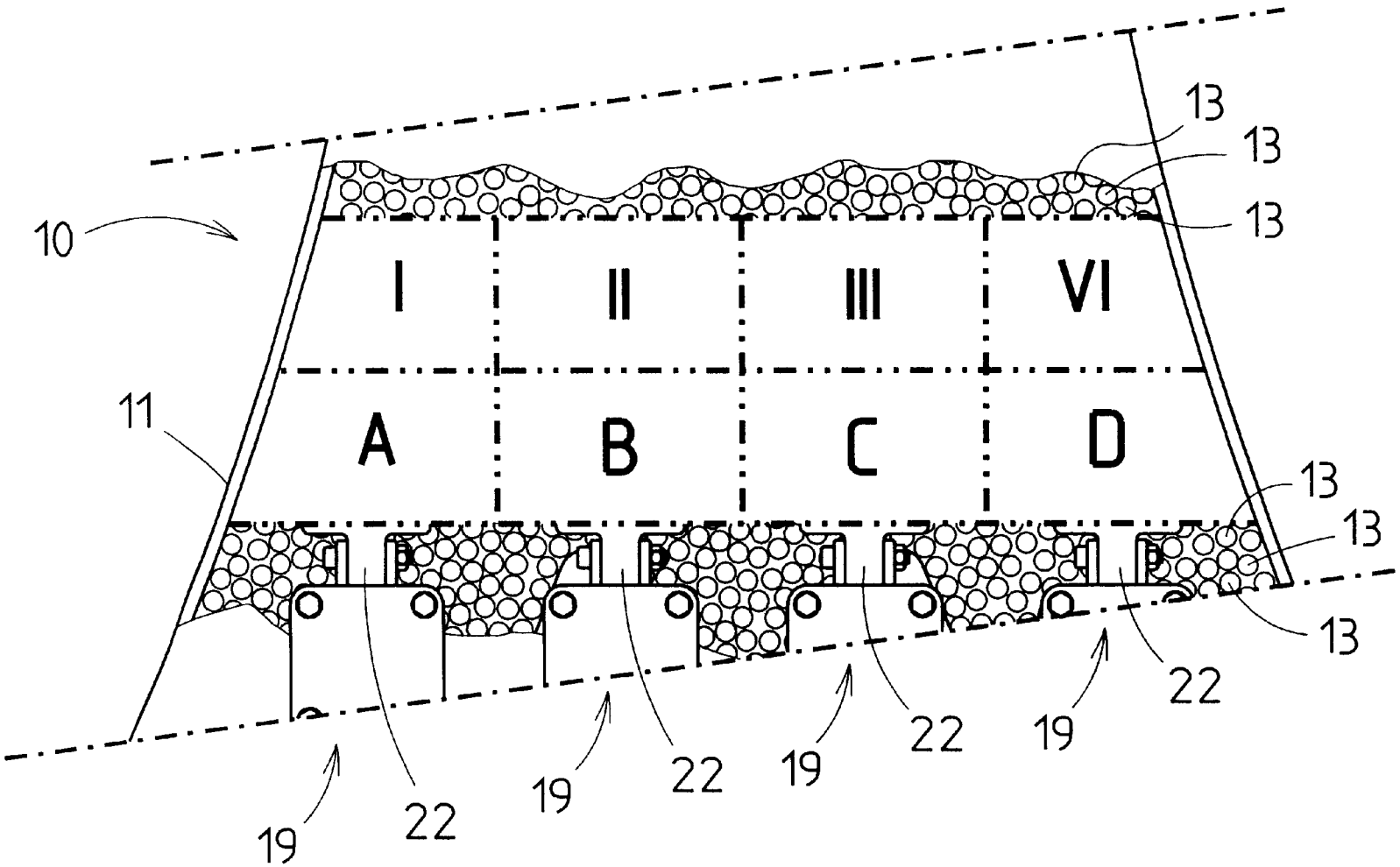
FIG. 2 shows an enlarged detail of the storage part with a plurality of ejecting units and a plurality of schematically illustrated ejecting zones and evaluation zones.

FIG. 2 shows a detail of the storage part 11 of the cigarette magazine 10 in the region of the ejecting units 19 in an enlarged illustration. Four ejecting zones A to D are illustrated schematically above the ejecting units 19. Each of these four ejecting zones A to D is assigned to an ejecting unit 19. The cigarettes 13 located in an ejecting zone are ejected upon actuation of the corresponding ejecting unit 19. Four evaluation zones I to IV are located above the ejecting zones A to D, with each ejecting zone A to D being assigned to the respective evaluation zone I to IV above it. The ejecting zones A to D are selected in terms of their dimensions such that the width and/or the length of each ejecting zone A to D corresponds at least to the length of one cigarette. In particular the width. of an ejecting zone is selected to be greater than the height of the corresponding ejecting zone.

The evaluation zones I to IV correspond to the region monitored by the camera 17. The camera 17 picks up an image of all the evaluation zones I to IV. During image processing, the image is subdivided into said four evaluation zones I to IV. Each of these four evaluation zones I–V is evaluated separately. If, in the region of an evaluation zone, a transversely located, that is to say incorrectly positioned cigarette, or a cigarette which is formed incorrectly in some other way, is detected, the corresponding ejecting unit 19 located therebeneath is actuated with a time delay. Said ejecting unit ejects the cigarettes 13 located in the corresponding ejecting zone A–D.

The time delay between detection of a defective or incorrectly positioned cigarette 13 and actuation of the corresponding ejecting unit 19 is determined by the time required for such a cigarette to move downwards from an evaluation zone I–IV into an ejecting zone (approximately 10–20 seconds). As an alternative to a camera 17, which records an image of all four evaluation zones I to IV, however, it is also possible to install a plurality of cameras 17 which each scan an image of an evaluation zone I–IV and then feed this to image processing.

In the region of the evaluation zones I to IV, the front wall of the cigarette magazine 10 is of transparent configuration, for example by virtue of a glass or plastic panel being introduced, with the result that the camera 17 has a free view of the cigarette ends.

Figure 3:
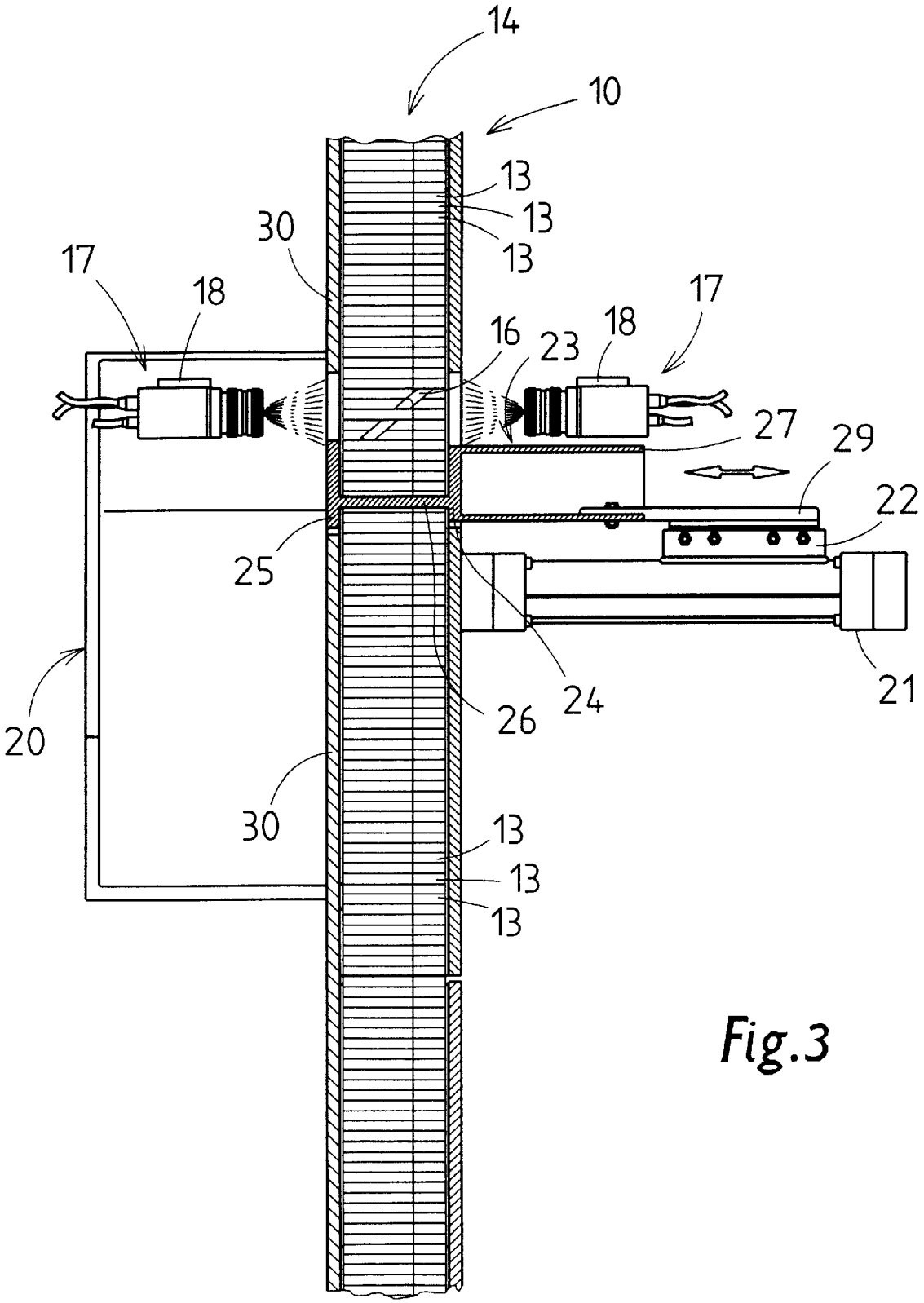
FIG. 3 shows the cigarette magazine from FIG. 1 in a side view along section line III—III according to FIG. 1 with an ejecting unit in the through-passage position.

FIG. 3 shows a section of a lateral view of the cigarette magazine 10 along line III—III from FIG. 1. Two cameras 17 are provided, to be precise one on the front side, and one on the rear side, of the cigarette magazine 10. The arrangement of two cameras 17 means that defective or incorrectly positioned cigarettes 16 can be detected more reliably.

In the example shown, a transversely located cigarette 16 is located within the evaluation zone II. This transversely located cigarette 16 is detected by the cameras 17. The image-processing device 18 evaluates the detected image of the transversely located cigarette 16 and—once the defectively positioned cigarette 16 has been detected—produces an error signal. This error signal results in the ejecting unit 19 being actuated. The ejector 23 is thus displaced in the direction of the chute 20. For this purpose, the linear cylinder of the ejecting unit 19 together with the carriage 22 and the ejector 23 fastened thereon, including the housing-like device 27, are displaced in the direction of the chute 20.

There is also a connecting element 29 located between the ejector 23 and carriage 22. This connecting element 29 ensures the necessary distance between the carriage 22 and ejector 23. This distance is such that the ejector 23 can be pushed into the cigarette magazine 10 to the extent where the front wall 24 of the ejector 23 reaches the rear wall 30 of the cigarette magazine 10.

Figure 4:
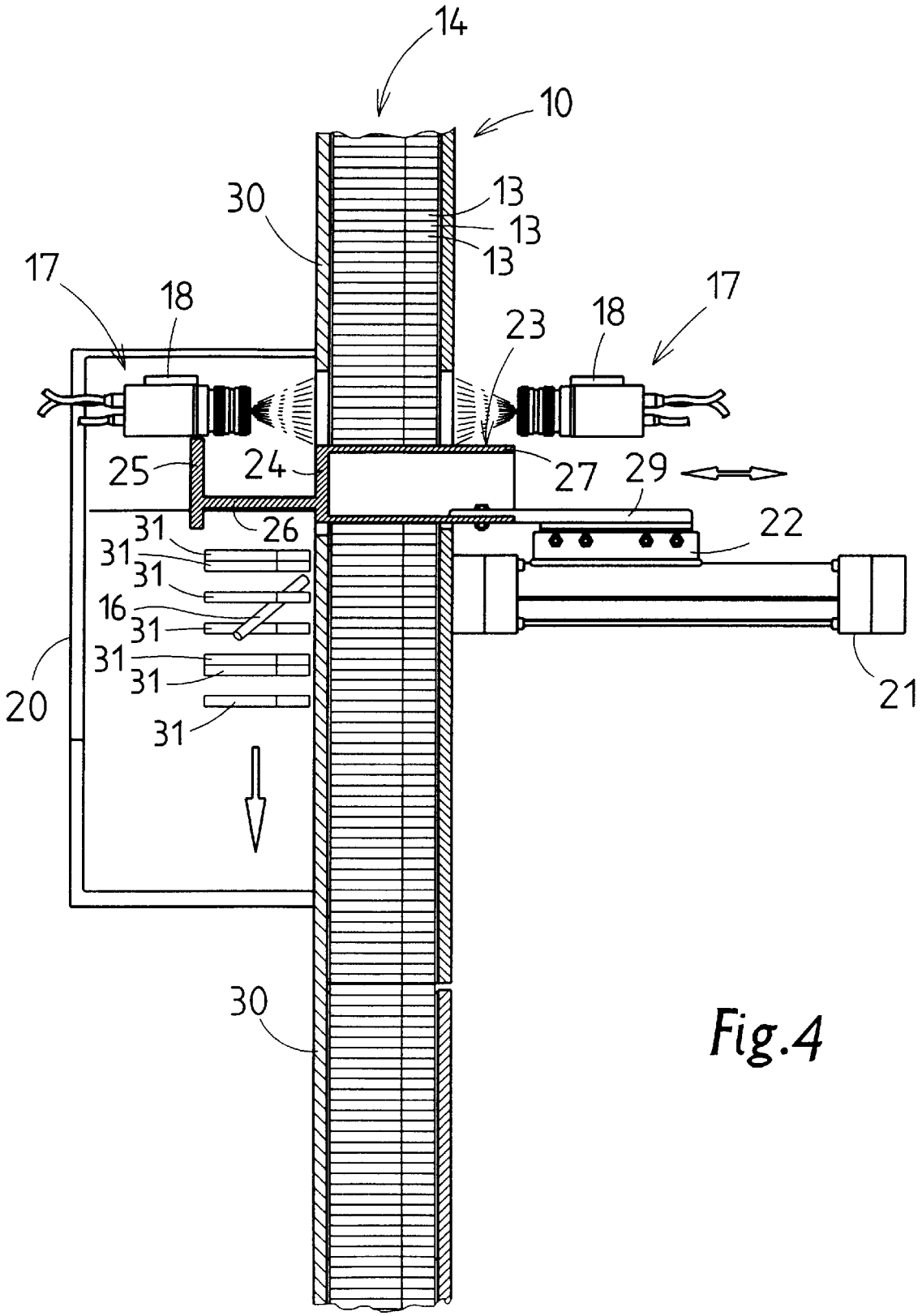
FIG. 4 shows the cigarette magazine from FIG. 3 with an ejecting unit in the ejecting position.

FIG. 4 shows the ejecting unit 19 in the ejecting position, i.e. the ejector 23 is located in its left-hand or chute-side end position. In the position illustrated, the front wall 24 of the ejector 23 terminates with the outer surface of the rear wall 30 of the cigarette magazine 10, with the result that the ejected cigarettes 31—including the transversely located cigarette 16—can drop into the chute 20 without obstruction. The housing-like device 27, which is connected to the front wall 24 of the ejector 23, blocks the cigarette magazine 10 in the region of this ejecting unit 19, with the result that initially no cigarettes 13 can follow on in this region. It is only when the ejecting unit 19 is located in its through position (according to FIG. 3) again that cigarettes drop into the previously formed cavity again and thus refill the region of the relevant ejecting zone B.

Although the ejecting unit 19 is generally only actuated when a defective or incorrectly positioned cigarette 16 has been detected, it may also be actuated for other reasons. In particular it is also possible for the ejecting unit 19 to be triggered manually. This is particularly expedient eliminating errors which are not detected automatically. Actuation of the ejecting unit 19 which is not manual or triggered by image processing is also employed to take samples (for example at regular time intervals).

However, the detection of a defective or incorrectly positioned cigarette using a camera and downstream image processing, and a possibly triggered optical and/or acoustic error signal, may also lead to an operator eliminating disruption manually, in particular if an operation for eliminating the disruption automatically—for example by actuating the ejecting unit 19—has failed or would fail.

Overall, the greatest advantages can be achieved when the combination of the above-described automatic detection of a defective or incorrectly positioned cigarette is coupled to an ejecting unit.

| List of designations | |
|---|---|
| 10 | Cigarette magazine |
| 11 | Storage part |
| 12 | Shaft group |
| 13 | Cigarette |
| 14 | Opening |
| 15 | Oscillating rod |
| 16 | Transversely located cigarette |
| 17 | Camera |
| 18 | Image-processing device |
| 19 | Ejecting unit |
| 20 | Chute |
| 21 | Housing |
| 22 | Carriage |
| 23 | Ejector |
| 24 | Front wall of the ejector |
| 25 | Rear wall of the ejector |
| 26 | Connecting rod |
| 27 | Housing-like device |
| 28 | Distance |
| 29 | Connecting element |
| 30 | Rear wall of the cigarette magazine |
| 31 | Ejected cigarette |
| A | Ejecting zone |
| B | Ejecting zone |
| C | Ejecting zone |
| D | Ejecting zone |
| I | Evaluation zone |
| II | Evaluation zone |
| III | Evaluation zone |
| IV | Evaluation zone |

What is claimed is:

1. An apparatus for detecting defective and/or incorrectly positioned cigarettes (16) in a cigarette magazine (10) of a cigarette-production and/or cigarette-packaging machine, characterized by:

a stationary optical checking element (17) which is arranged in a region of the cigarette magazine (10) and is intended for scanning at least one image of a plurality of cigarettes (13, 16) located in the cigarette magazine (10);

an image-processing device (18) for evaluating the image;

means for producing an error signal if the scanned image is established as deviating from a reference image and/or from at least one reference value; and at least one or a plurality of adjacent ejecting units (19), which are arranged in a region of the cigarette magazine (10) and which are responsive to said error signal to eject a plurality of cigarettes (13, 16) located in an ejecting zone (A–D) of an ejecting unit (19).

2. The apparatus according to claim 1, characterized in that adjacent optical checking elements (17) are arranged on a front side and on a rear side, respectively, of the cigarette magazine (10) to scan the two end sides of correctly formed and/or correctly positioned cigarettes (13).

3. The apparatus according to claim 1, wherein said optical checking element (17) is a camera.

4. An apparatus for eliminating defective and/or incorrectly positioned cigarettes (16) in a cigarette magazine (10) of a cigarette-production and/or cigarette-packaging machine, said apparatus comprising at least one or a plurality of adjacent ejecting units (19), which are arranged in a region of the cigarette magazine (10), for ejecting a plurality of cigarettes (13, 16) located in an ejecting zone (A–D) of an ejecting unit (19), wherein each ejecting unit (19) has a front wall (24), of which a surface area defines the ejecting zone (A–D), and a rear wall (25), of which the contour is larger than the contour of the front wall (24) by at least the width of one cigarette, and wherein the front wall (24) and the rear wall (25) of the ejecting unit (19) are spaced apart parallel to one another, essentially by a distance of the length of one cigarette, and are connected to one another by means of a connecting element.

5. The apparatus according to claim 4, wherein the connecting element is a connecting rod 26.

6. An apparatus for eliminating defective and/or incorrectly positioned cigarettes (16) in a cigarette magazine (10) of a cigarette-production and/or cigarette-packaging machine, said apparatus comprising at least one or a plurality of adjacent ejecting units (19), which are arranged in a region of the cigarette magazine (10), for ejecting a plurality of cigarettes (13, 16) located in an ejecting zone (A–D) of an ejecting unit (19), wherein the ejecting zone has a width and/or a height which corresponds at least to the length of one cigarette.

* * * * *